US005180165A

United States Patent [19]

Frost

[11] Patent Number: 5,180,165

[45] **Date of Patent: * Jan. 19, 1993**

[54] HAND ACCESSORY

[76] Inventor: John H. Frost, 781 S. Kohler St., Los Angeles, Calif. 90021

[ * ] Notice: The portion of the term of this patent subsequent to Dec. 3, 2008 has been disclaimed.

[21] Appl. No.: 783,176

[22] Filed: Oct. 28, 1991

Related U.S. Application Data

[63] Continuation-in-part of Ser. No. 611,616, Nov. 13, 1990, Pat. No. 5,069,454.

[51] Int. Cl.[5] ..... A63B 57/00

[52] U.S. Cl. ..... 273/165; 2/20; 273/166

[58] Field of Search ..... 273/25, 26 B, 26 C, 273/165, 166; 2/20, 21

[56] References Cited

U.S. PATENT DOCUMENTS 1,200,580 10/1916 Brenner ..... 2/20
1,690,312 11/1928 Rosan ..... 273/165
3,879,048 4/1975 Penney ..... 273/165 X
4,461,043 7/1984 Lomedico ..... 273/26 CX
5,069,454 12/1991 Frost ..... 273/165

FOREIGN PATENT DOCUMENTS 322512 12/1929 United Kingdom ..... 273/165

*Primary Examiner*—William H. Grieb
*Attorney, Agent, or Firm*—Jack C. Munro

[57] ABSTRACT

A hand accessory contoured to fit into the web portion of the hand between the base of the thumb and the base of the forefinger, and to extend down into the palm to enable the handle of a piece of sport equipment or of a tool to be gripped snugly by the hand and to be swung to impact with a ball or other object without substantial movement of the web portion of the hand before or at impact relative to the remainder of the hand. This enables full force to be transmitted from the hand to the handle. The hand accessory may include a portion which presses against the exterior surface of the web portion.

5 Claims, 4 Drawing Sheets

HAND ACCESSORY

CONTINUING APPLICATION

This application is a Continuation-In-Part of U.S. patent application Ser. No. 07/611,616, filed Nov. 13, 1990, entitled "HAND ACCESSORY" now U.S. Pat. No. 5,059,454, issued Dec. 3, 1991.

BACKGROUND OF THE INVENTION

1. Field of the Invention

The present invention generally relates to hand accessories and more particularly to those useful for improving power transmission between the hand and the handle of an implement, such as a piece of sports equipment or a tool.

2. Prior Art

When gripping and swinging a handle of an implement such as a baseball bat, tennis racquet, hockey stick and hammer, there is a space between the handle and the base of the thumb and the forefinger, filled with a loose compressible web of skin. This area is a low density space which contains no bone or muscle. When the user swings the handle of the implement prior to impact, the handle moves from the fingers into the web of skin. At his time, the user loses power and control of the implement. Just immediately prior to impact, the implement will again move into the fingers. However, power and control have been lost, which in baseball is a sufficient difference to decrease a player's batting average by as much as one hundred points. To a professional ballplayer, even a small change in batting average can amount to a significant salary change.

At the force of impact, the implement will again recoil into the web, compressing it. This absorbs and dissipates energy otherwise transmissible to the ball or puck, thus causing a weaker than optimal shot. No matter how tightly one grips the handle, this space remains soft like a sponge. Both timing and power, as well as bat, racket or stick speed are lost, with the final result being a less than optimal or full-force shot. U.S. Pat. No. 4,461,043 seeks to provide a cushion in the hand web but does not improve speed or power transmission between the hand and handle of a baseball bat.

There remains a need for a simple device capable of increasing bat, racquet or hockey stick speed and of improving force transmission between the hand and handle of the bat, racquet or hockey stick for improved power hitting of a ball or puck. The device should be capable of being made in a variety of sizes and shapes and forms, and be capable of protecting the hand against injury. It should be utilizable with barbell weight lifting and other sports, and with various tools, such as hammers, etc. It also should reduce strain on the fingers. In the aforementioned C.I.P. patent application, the invention was directed primarily to the leading hand (the left hand for a righthanded baseball player). The structure in the C.I.P. application was L-shaped with a portion of the hand accessory overlaying the web. Within the trailing hand (the right hand), there is less need for any portion that overlies the web. Thus, the claimed present invention is directed in part to a hand accessory which has no portion that overlies the web.

SUMMARY OF THE INVENTION

The hand accessory comprises a contoured, shaped, solid plug which has a generally inverted L-shape in side elevation with a horizontal top portion extending over the top of the web of the hand between the base of the thumb and the base of the forefinger. A vertical portion is integral with the horizontal portion and descends therefrom down into the palm of the hand. The front of the plug is curved to fit the curve of the handle of the bat, hockey stick, racquet or the like. It may be resilient and grooved, notched or serrated to allow it to adapt to various handle contours, such as hammers and other hand held tools. The rear of the plug may be resilient and the front of the plug relatively inflexible. A vertical slot may be present in the front of the plug to hold a removable reinforcing metal insert or the like. The hand accessory may also be in the form of a solid plug without a horizontal top portion. Further, the hand accessory which includes a horizontal top portion may include a back section extending from the horizontal top portion to rest against the back side of the web. Still further, the plug may include a lateral flange to be positioned against the ball of the thumb.

Because the plug fills the web space, rather than protruding out in a bulky fashion, it may be worn unnoticed under a batting glove (permanently attached or removable), which, in turn, may be worn under a fielding glove with no interference in performance.

Also, the plug may removably fit into a pocket of a batting glove, hockey glove, etc., or be attached to the front of the web area thereof. Alternatively, it can bear elastic straps and be attachable around the hand or wrist of the user without use of a glove. The plug can also be connected releasably or permanently to the handle of the bat, racquet, stick, etc., as by adhesive, spring clip or the like. The accessory can be used with hand tools, barbells and all types of handle-bearing sport equipment. It could also be built permanently into any handle.

To increase leverage, the plug design including the horizontal top portion creates a fulcrum to enhance the power transmittability from the hand to the tool.

DETAILED DESCRIPTION

FIGS. 1–4

Figure 1:
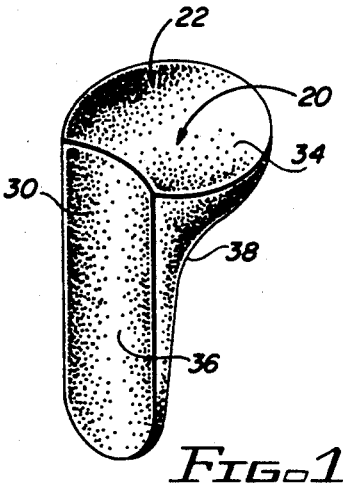
FIG. 1 is a schematic side perspective view of a first preferred embodiment of the hand accessory of the present invention.

Now referring more particularly to FIGS. 1–4 of the drawings, a first preferred embodiment of the hand accessory of the present invention is schematically depicted therein. Thus, hand accessory 20 is shown, which comprises a solid plug 22 having a contoured shape to fit snugly into the web 24 of the hand 25 (FIG. 4) between the base of the thumb 26 and the base of the forefinger 28, with the front 30 of plug 22 having a curvature to match that of the handle 32 of a bat, racquet, hockey stick or the like (not shown).

Plug 22 is generally inverted L-shaped in side elevation, with an upper generally horizontal portion 34 and a integral descending vertical portion 36. The rear 38 of plug 22 is curved to fit over and around the front of web 24 and down into the palm of hand 25, abutting it. Thus, horizontal portion 34 tapers or thins rearwardly, while vertical portion 36 tapers or thins downwardly.

Figure 2:
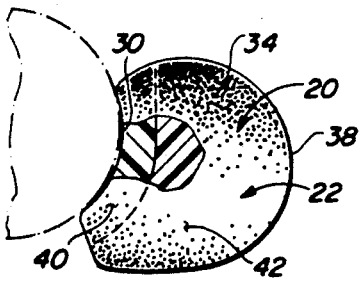
FIG. 2 is a schematic top plan view, partly broken away, of the accessory of FIG. 1 abutting a baseball bat handle.
Figure 3:
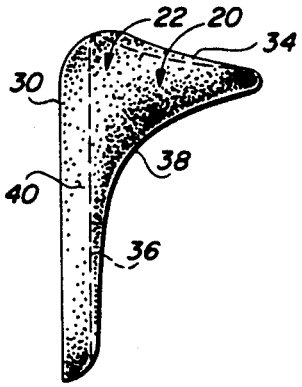
FIG. 3 is a schematic side elevation of the accessory of FIG. 1.
Figure 4:
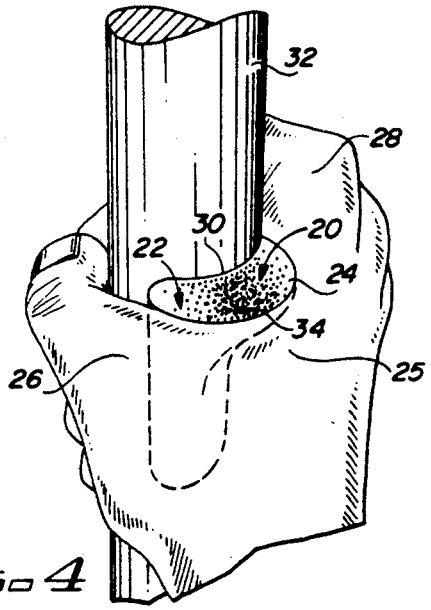
FIG. 4 is a schematic rear perspective view of the accessory of FIG. 1, shown being used around a baseball bat handle which is gripped by a player.

As shown in FIG. 2, plug 22 may be constructed of a relatively inflexible hard portion 40 of plastic, metal, wood, or the like near to and forming front 30, and a relatively flexible portion 42 of rubber, plastic, or the like near to and forming rear 38. It will be understood that, if desired, plug 22 could be fabricated of all hard materials, such as metal, hard plastic, etc., or of a somewhat flexible material such as soft rubber, soft plastic, or the like.

It will be understood that plug 22 can be of various sizes and shapes. It can be fashioned to fit a particular hand web and palm perfectly when the hand is wrapped around the handle of an implement such as a bat, racquet, hockey stick or a tool such as a hammer, shears, pliers, etc.

Plug 22 can be disposed within the pocket of a glove (not shown) to be worn on the hand, or glued or otherwise secured to the front of the web portion thereof. Alternatively, plug 22 can be clipped, glued or otherwise attached permanently or releasably to the handle 32. Plug 22, when used, fills the web 24 of hand 25 and contacts the palm of that hand, curving to fit handle 32 and enabling handle 32 to be swung without rocking back and forth in compressed web 24, thus facilitating a more compact, more rapid and more powerful swing with handle 32.

Moreover, upon contact of the head of the bat, racquet or stick to which handle 32 is attached and forms part thereof with a baseball or the like, full force is transmitted to such ball to drive it farther, because web 24 does not recoil, or move backward in hand 25 and absorb some of such force, but is relatively immobile relative to hand 25. The net result is a more powerful hit or shot.

The same situation applies when handle 32 is attached to the operating head of a tool such as a hammer. A blow delivered thereby is more forceful. Inasmuch as the parts of hand 25 in the force-transmitting area hold the relatively resilient but compressed portion 42 of plug 32, the shock felt by the hand 25 upon striking the ball, puck, etc., is uniformly distributed throughout hand 25 and hand 25 is thereby effectively protected against injury.

Accordingly, hand accessory 20 not only protects hand 25 but assures maximum speed of handle 32 and maximum delivery of force from hand 25 to the object being hit by means of handle 32 for maximum results.

Figure 5:
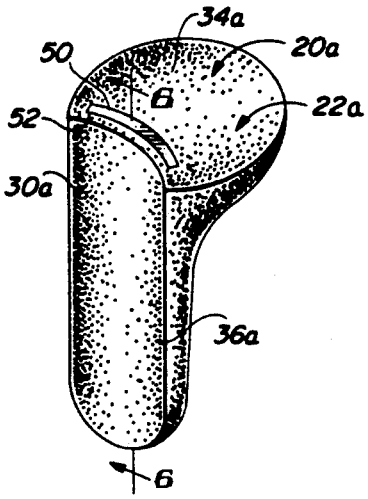
FIG. 5 is a schematic side perspective view of a second preferred embodiment of the hand accessory of the present invention.
Figure 6:
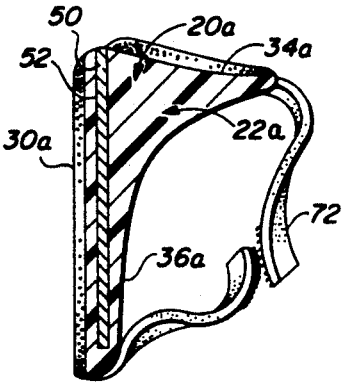
FIG. 6 is a schematic section taken along the section line 6—6 of FIG. 5.

FIGS. 5 and 6

A second preferred embodiment of the hand accessory of the present invention is schematically depicted in FIGS. 5 and 6. Thus, hand accessory **20*a* is shown. Components thereof similar to those of accessory 20 bear the numerals but are succeeded by the letter "a". Accessory 20*a* is substantially identical to accessory 20**, except as follows:

a) plug **22*a*** is formed of a single uniform, sightly flexible material, such as plastic, or rubber; and
b) the front portion **30*a* is stiffened and strengthened through the use of a curved steel plate 50 releasably disposed in a vertical slot 52** therein.
c) an elastic strap 72 is secured to plug **22*a***.

Plug **22*a* has substantially the advantage of plug 22**.

FIG. 7

Figure 7:
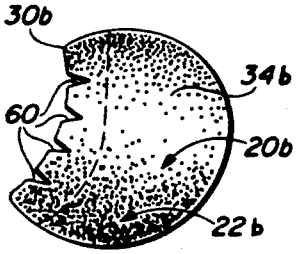
FIG. 7 is a schematic top plan view of a third preferred embodiment of the hand accessory of the present invention.

A third preferred embodiment of the hand accessory of the present invention is schematically depicted in FIG. 7. Thus, hand accessory **20*b* is shown. Components thereof similar to those of accessory 20 or 20*a*** bear the same numerals, but are succeeded by the letter "b".

Accessory **20*b* is substantially identical to accessory 20*a*** except as follows:

a) accessory **20*b*** has no steel plate or slot; and,
b) the resiliency and confirmability of front **30*b* to various handles is increased by providing front 30*b* with a plurality of spaced vertical notches 60**.

Plug **22*b* has substantially the advantages of plugs 22 and 22*a***.

Figure 8:
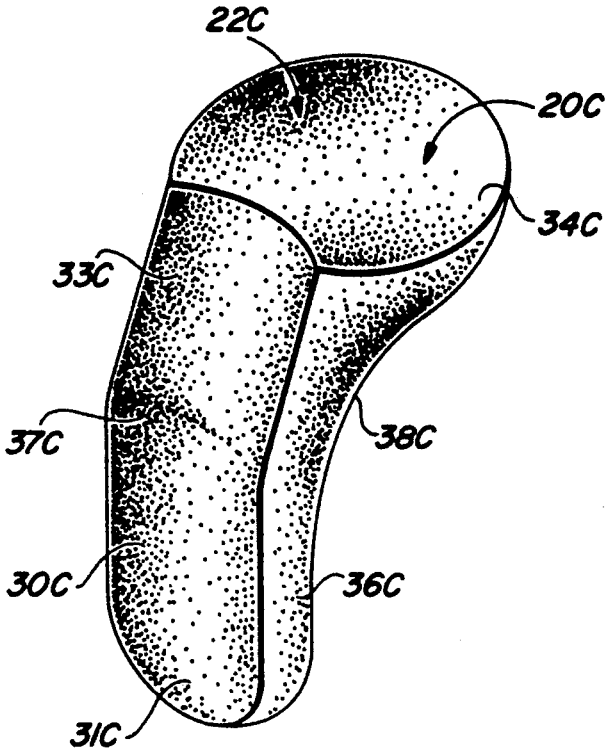
FIG. 8 is a schematic side perspective view of a fourth preferred embodiment of the hand accessory of the present invention.
Figure 9:
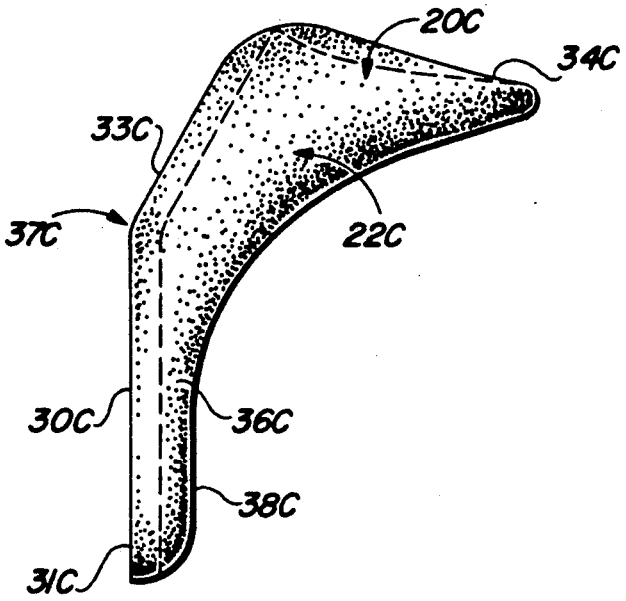
FIG. 9 is a schematic side elevation of the accessory of FIG. 8.

FIGS. 8 and 9

A fourth preferred embodiment of the hand accessory of the present invention is schematically depicted in FIGS. 8 and 9. Thus, hand accessory **20*c* is shown. Components thereof similar to those of accessory 20, 20*a*, or 20*b*** bear the same numerals, but are succeeded by the letter "c".

Accessory **20*c* is substantially identical to accessory 20 except that front 30*c* does not extend vertically in substantially a straight line. Instead, the front 30*c* of plug 22*c* has lower portion 31*c* and an upper portion 33*c* which lie at an angle with respect to one another. This design essentially provides a fulcrum at 37*c* which lies below the top 34*c*, as opposed to the fulcrum of plug 22 of FIG. 1, which lies at the intersection of top 22 and front 30** thereof.

The design of plug **22*c* moves the fulcrum of the tool such as bat 32, closer to the base of the hand 26**, resulting in a greater force being transmitted by the hand to the bat as it moves through its operative positions, resulting in a more efficient transfer of power.

It can be appreciated that a sharp fulcrum point 37*c* is not absolutely necessary. A more rounded vertical front portion 30*c* can be provided with a slightly round fulcrum at 37*c*, without departing from the scope of the present invention. Plug 22*c* has substantially all the other advantages of plugs 22, 22*a* and 22*b*.

FIGS. 10–12

Figure 10:
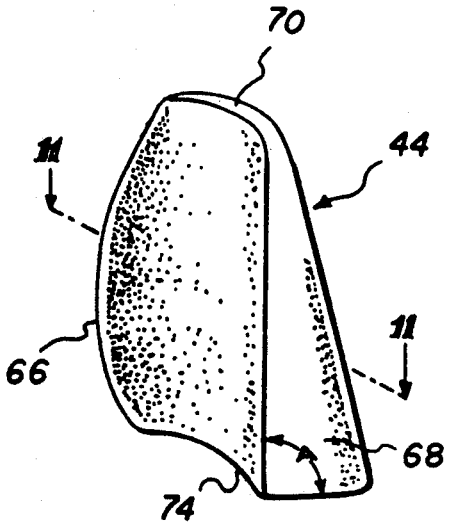
FIG. 10 is a front isometric view of a fifth embodiment of this invention.
Figure 12:
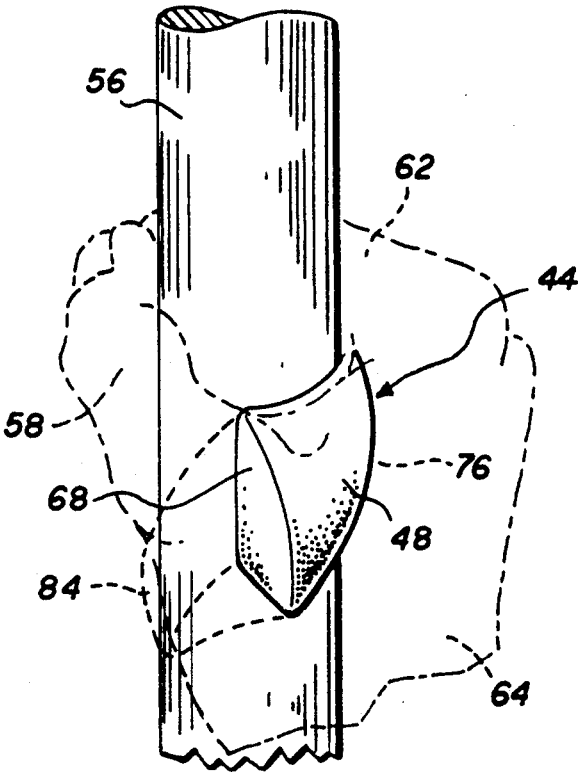
FIG. 12 is a view similar to FIG. 4 but with the embodiment of FIG. 10 shown in solid lines and the embodiment of FIGS. 13 and 14 shown in dotted lines.
Figure 11:
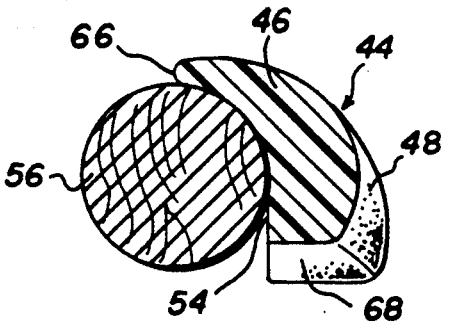
FIG. 11 is a cross-sectional view taken along line 11—11 of FIG. 10 showing the connection with a baseball bat handle.

Within FIGS. 10–12 there is shown the fifth embodiment, embodiment 44 of this invention. This embodiment 44 comprises a hand accessory in the form of a solid plug 46 which again will be made of a rigid material such as a plastic. The plug 46 is defined by an arcuate back surface 48 which is basically convex and a concave front surface 54. Baseball bat handle 56 is to rest within and closely confirm to the concave front service 54. The back surface 48 is to press into and tightly fit within the web section between the thumb 58 and the forefinger 62 of the hand 64 shown in FIG. 12.

The inner end 66 of the plug 46 basically constitutes no more than a thin ridge. The outer end 68 of the plug 46 is plainer and basically is in the shape of a right triangle with angle A comprising the right angle. The plug 46 also has a thin top edge 70 and a substantially plainer bottom surface 74.

The embodiment of FIGS. 10–12 is a primary advantage when used in conjunction with the trailing hand when swinging the baseball bat handle 56. Plug 46 provides control and power directly to the baseball bat handle 56 from the web area 76 of the hand 64. Correct using of a baseball bat teaches to keep the handle 56 out in the fingers. A good batter will start and end their swing in that position. However, during the middle of the swing, there has to be a certain amount of whipping motion which causes the handle 56 to tend to move back into the web 76. The plug 46 allows the handle 56 to whip back partially into the web 76 while at the same time the portion of the handle 56 just below the web 76 is held out in the fingers. For a batter to keep the handle 56 out in the area of the fingers without the use of the plug 46 requires a great amount of hand/finger strength. This requirement of such strength diminishes the relaxation of the muscles and therefore deters accuracy and control in swinging of the bat handle 56.

Figure 13:
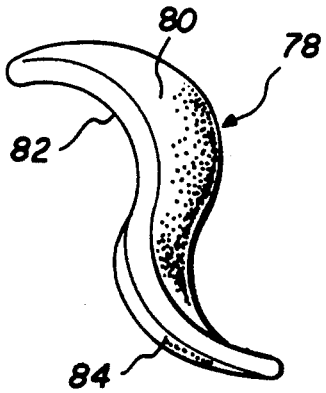
FIG. 13 is a top plan view of a sixth embodiment of this invention.
Figure 14:
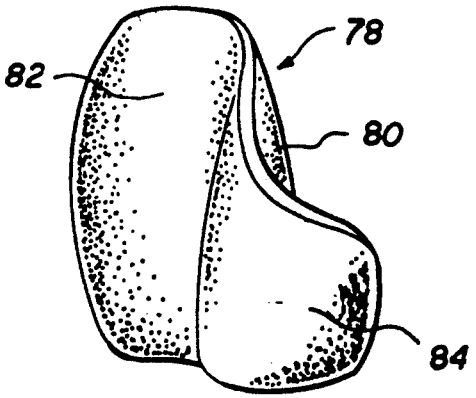
FIG. 14 is a front isometric view of the sixth embodiment of this invention.

FIGS. 13 and 14

Referring particularly to FIGS. 13 and 14 there is shown sixth embodiment 78 of this invention. The sixth embodiment 78 is in the form of a plug which has a convex back surface 80 and a concave front surface 82. The sixth embodiment 78 is basically similar to embodiment 44 with the exception that there is a lateral flange 84 extending from outer end 68 of the fifth embodiment 44. This lateral flange 84 is to fit over in a close conforming manner the ball of the thumb. The flange 84 functioning as a positioner tending to maintain the body of the sixth embodiment 78 in its position within the web 76.

FIGS. 15–17

Figure 15:
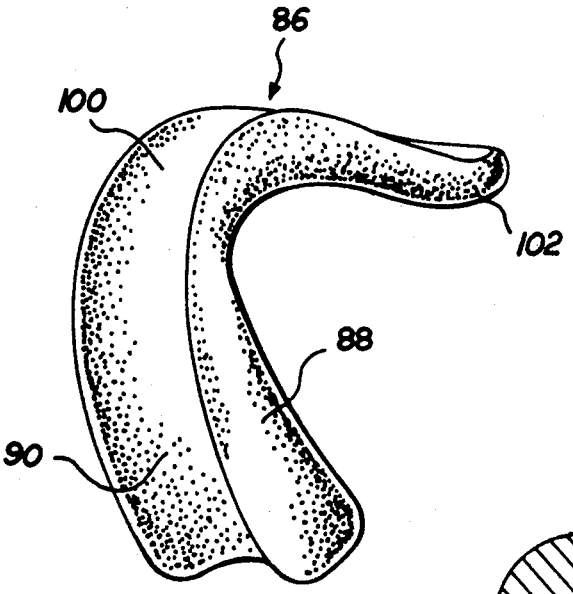
FIG. 15 is a front isometric view of a seventh embodiment of this invention.
Figure 16:
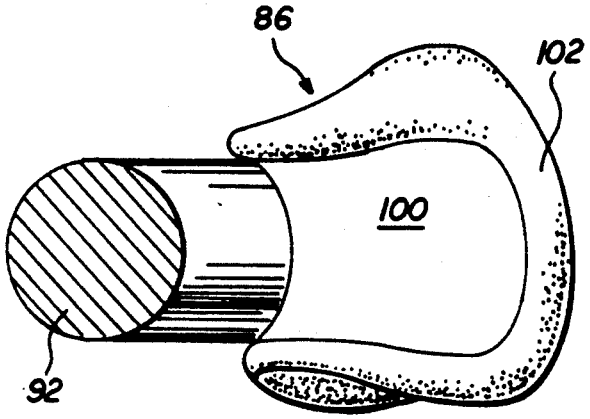
FIG. 16 is a top plan view of a seventh embodiment of this invention.
Figure 17:
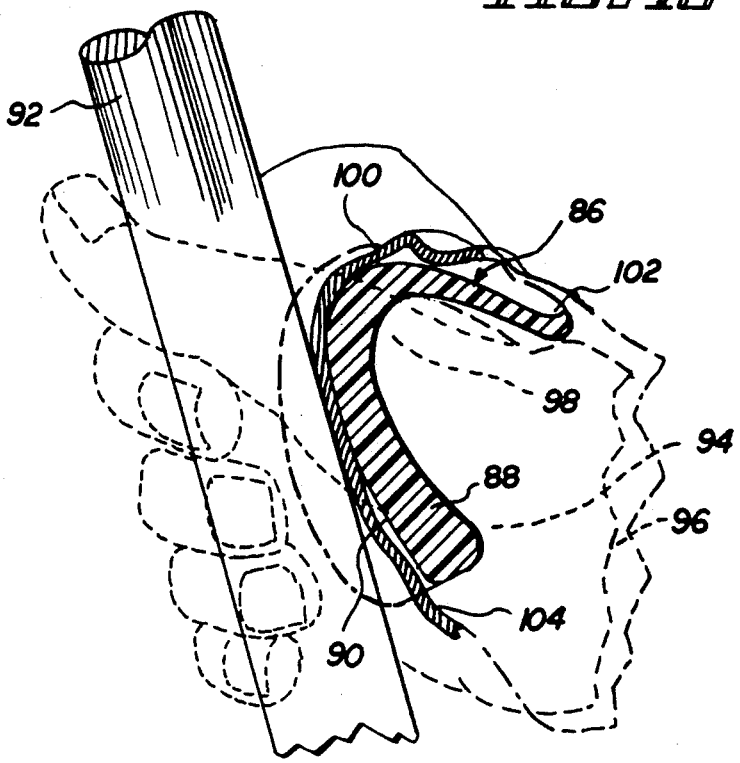
FIG. 17 is a schematic side isometric view of the seventh embodiment showing such being used in conjunction with a baseball bat handle.

Referring particularly to FIGS. 15–17 of the drawings there is shown the seventh embodiment 86 of this invention. The seventh embodiment 86 includes a plug body which is formed of a convex back surface 88 and a concave front surface 90. The baseball bat handle 92 is to rest and closely conform within the concave front surface 90. Convex back surface 88 rests against the palm 94 of the hand 96 and also against the web 98. Basically, the portion of the seventh embodiment 86 which is composed of sections 88 and 90 is essentially similar to embodiment 44. The main distinction of the seventh embodiment 86 is that there is included a top portion 100 which overlies the web 98 and a further downward depending portion 102 which tightly presses against the exterior surface of the web 98. The downwardly depending portion 102 functions to push the web 98 in an inward direction which presses the plug of the seventh embodiment 86 into the baseball bat handle 92. Actually it is envisioned that this pressing movement is to be further applied by the user wearing of a glove 104 which will provide a constraining movement on the exterior surface of the downwardly depending portion 102 which thereby further assists in pressing the main portion of the plug of the seventh embodiment 86 toward the handle 92.

What is claimed is:

1. A hand accessory to be used in conjunction with the handle of an implement, said accessory comprising a solid plug contoured to fit into the web portion of the hand between the ball of the thumb and the base of the forefinger and to extend down into the palm of the hand, said plug having a front surface which is concavely curved to fit the contour of the handle of the implement when held in the hand, said plug having a convexly curved back surface which is to impress into the web portion and into the palm of the hand, said plug being adapted to transmit full power directly between the hand and handle without substantial relative movement of the web; and said concave front surface extends in substantially a straight line forming a side of a right triangle at an outer end which is located nearest the thumb of the user.

2. A hand accessory to be used in conjunction with the handle of an implement that is not attached to said handle, said hand accessory comprising a plug contoured to substantially completely cover and rest against the palm web surface of the portion of the hand between the base of thumb and the base of the forefinger and extend down into the palm of the hand, said plug being U-shaped in configuration defining a top portion to be located across the web portion and a downwardly depending portion to be located against the exterior surface of the web portion, said plug having a front surface which is concavely curved to conform to the contour of the handle of the implement when grippingly held in the hand, said plug having a back surface curved convexly to conform to the palm of the hand when gripping the handle, said plug being adapted to transmit muscular power during the swinging movement of the handle directly between the hand and the handle without substantial relative movement of the plug and the web portion of the hand.

3. In combination with the handle of an implement where said handle is to be manually swung in motion by a hand of the human being and in combination with the human hand that has a palm and a web portion located between the thumb and forefinger, a separate hand accessory to be positioned between said handle and said hand, said hand accessory comprising:

a plug having a concave front surface and a convex back surface, said front surface to closely conform to the handle of the implement, said back surface comfortably pressing into the palm and web portion of the hand, whereby said hand accessory functions to facilitate the transmission of a manual swinging force between said hand and said handle; and said plug having a lateral flange positioned against the ball of the thumb.

4. In combination with the handle of an implement where said handle is to be manually swung in motion by a hand of the human being and in combination with the human hand that has a palm and a web portion located between the thumb and forefinger, a separate hand accessory to be positioned between said handle and said hand, said hand accessory comprising:

a plug having a concave front surface and a convex back surface, said front surface to closely conform to the handle of the implement, said back surface comfortably pressing into the palm and web portion of the hand, whereby said hand accessory functions to facilitate the transmission of a manual swinging force between said hand and said handle; and said plug having a planar outer end forming a right triangle which is a shape that facilitates the transfer of power into said handle.

5. In combination with the handle of an implement where said handle is to be manually swung in motion by a hand of the human being and in combination with the human hand that has a palm and a web portion located between the thumb and forefinger, a separate hand accessory to be positioned between said handle and said hand, said hand accessory comprising:

a plug having a concave front surface and a convex back surface, said front surface to closely conform to the handle of the implement, said back surface comfortably pressing into the palm and web portion of the hand, whereby said hand accessory functions to facilitate the transmission of a manual swinging force between said hand and said handle; and said plug having a top portion extending over said web portion, a downwardly depending portion integrally attached to said top portion, said downwardly depending portion to press tightly against the exterior surface of said web portion.

* * * * *